US012263374B2

(12) United States Patent
Mickolio

(10) Patent No.: US 12,263,374 B2
(45) Date of Patent: Apr. 1, 2025

(54) METHODS OF UTILIZING STRENGTHENING AND REHABILITATION APPARATUS

(71) Applicant: Titin KM Biomedical Corp., Bozeman, MT (US)

(72) Inventor: Kole L. Mickolio, Billings, MT (US)

(73) Assignee: Titin KM Biomedical Corp., Bozeman, MT (US)

( * ) Notice: Subject to any disclaimer, the term of this patent is extended or adjusted under 35 U.S.C. 154(b) by 0 days.

(21) Appl. No.: 18/581,135

(22) Filed: Feb. 19, 2024

(65) Prior Publication Data

US 2024/0189661 A1 Jun. 13, 2024

Related U.S. Application Data

(63) Continuation of application No. 18/123,152, filed on Mar. 17, 2023, now Pat. No. 11,938,373, which is a (Continued)

(51) Int. Cl.
*A63B 23/12* (2006.01)
*A63B 21/00* (2006.01)

(Continued)

(52) U.S. Cl.
CPC .... *A63B 23/1254* (2013.01); *A63B 21/00069* (2013.01); *A63B 21/015* (2013.01);

(Continued)

(58) Field of Classification Search
CPC ..... A63B 21/00069; A63B 21/015; A63B 21/4035; A63B 21/4049; A63B 21/012;

(Continued)

(56) References Cited

U.S. PATENT DOCUMENTS 3,428,311 A * 2/1969 Mitchell ..... A63B 23/12 482/130
4,249,727 A 2/1981 Dehan (Continued)

FOREIGN PATENT DOCUMENTS

AU 653426 9/1994
EP 1520605 4/2005

(Continued)

OTHER PUBLICATIONS

International Search Report and Written Opinion for related International Application No. PCT/US2022/023150, mailed Jul. 5, 2022, 12 pages.

(Continued)

*Primary Examiner* — Megan Anderson
(74) *Attorney, Agent, or Firm* — Klarquist Sparkman, LLP

(57) ABSTRACT

Strengthening and rehabilitation apparatus and methods of use. A strengthening and rehabilitation apparatus includes a base, a shaft having a distal end portion and a proximal end portion pivotably coupled to the base, a rest structure rotatably coupled to the distal end portion of the shaft. A method of use includes adjusting resistance of a joint within the base to provide a selected degree of resistance for restricting movement of the shaft relative to the base, supporting a first portion of a user's body on the rest structure, and moving the rest structure with the first portion of the user's body supported thereon along an exercise pathway, thereby moving the shaft relative to the base with the selected degree of resistance and rotating the rest structure relative to the shaft as the shaft moves relative to the base.

15 Claims, 4 Drawing Sheets

Related U.S. Application Data continuation of application No. 17/392,070, filed on Aug. 2, 2021, now Pat. No. 11,607,586.

(60) Provisional application No. 63/060,584, filed on Aug. 3, 2020.

(51) Int. Cl.
*A63B 21/015* (2006.01)
*A63B 23/035* (2006.01)

(52) U.S. Cl.
CPC ..... *A63B 21/4035* (2015.10); *A63B 21/4049* (2015.10); *A63B 23/03508* (2013.01)

(58) Field of Classification Search
CPC ..... A63B 21/0125; A63B 21/4005; A63B 21/4017; A63B 21/4019; A63B 21/4021; A63B 23/03508; A63B 23/1254
See application file for complete search history.

(56) References Cited

U.S. PATENT DOCUMENTS

| | | | | |
|---|---|---|---|---|
| 4,629,185 | A | 12/1986 | Amann | |
| 4,872,668 | A | 10/1989 | McGillis et al. | |
| 5,013,034 | A | 5/1991 | March et al. | |
| 5,178,160 | A | 1/1993 | Gracovetsky et al. | |
| 5,244,444 | A * | 9/1993 | Wostry | A63B 21/4047 482/109 |
| 5,755,645 | A | 5/1998 | Miller et al. | |
| 6,676,570 | B2 | 1/2004 | Valentino | |
| 7,115,078 | B1 * | 10/2006 | Kalember | A63B 21/4035 482/133 |
| 8,360,935 | B2 | 1/2013 | Olsen et al. | |
| 8,636,630 | B2 * | 1/2014 | Morris | A63B 23/1209 482/117 |
| 9,861,856 | B1 | 1/2018 | Miller et al. | |
| 10,022,578 | B2 | 7/2018 | Kelly | |
| 10,159,871 | B2 | 12/2018 | Miller et al. | |
| 10,357,678 | B2 | 7/2019 | Brown | |
| 10,427,000 | B1 * | 10/2019 | Miller | A63B 21/015 |
| 10,449,413 | B2 | 10/2019 | Goldston et al. | |
| 10,888,732 | B2 | 1/2021 | Miller et al. | |
| 11,103,751 | B2 | 8/2021 | Miller et al. | |
| 12,011,639 | B2 | 6/2024 | Miller et al. | |
| 2003/0013586 | A1 * | 1/2003 | Rothschild | A63B 23/03541 482/70 |
| 2007/0066918 | A1 | 3/2007 | Dewald et al. | |
| 2007/0184941 | A1 | 8/2007 | Krietzman | |
| 2008/0234116 | A1 * | 9/2008 | Elzerman | A63B 21/015 482/123 |
| 2011/0300994 | A1 | 12/2011 | Verkaaik et al. | |
| 2013/0338547 | A1 | 12/2013 | Shimizuhira et al. | |
| 2021/0291010 | A1 | 9/2021 | Miller et al. | |
| 2021/0387055 | A1 | 12/2021 | Miller et al. | |
| 2024/0123289 | A1 | 4/2024 | Miller et al. | |

FOREIGN PATENT DOCUMENTS

| | | |
|---|---|---|
| WO | WO 96/12528 | 5/1996 |
| WO | WO 2004/073804 | 9/2004 |
| WO | WO 2005/074373 | 2/2005 |
| WO | WO 2005/032663 | 4/2005 |
| WO | WO 2021/188780 | 9/2021 |

OTHER PUBLICATIONS

International Search Report and Written Opinion dated Jan. 27, 2023, from International Patent Application No. PCT/US2022/045755, 9 pp.
Supplementary European Search Report dated Jan. 23, 2025, from European Patent Application No. 22782330.9, 9 pp.

* cited by examiner

METHODS OF UTILIZING STRENGTHENING AND REHABILITATION APPARATUS

CROSS REFERENCE TO RELATED APPLICATION

This application is a continuation of U.S. patent application Ser. No. 18/123,152, filed Mar. 17, 2023, which is a continuation of U.S. patent application Ser. No. 17/392,070, filed Aug. 2, 2021, now issued as U.S. Pat. No. 11,607,586, which claims priority to U.S. Provisional Patent Application No. 63/060,584, filed Aug. 3, 2020, each of which is incorporated by reference herein in its entirety.

FIELD

The present disclosure relates generally to exercise equipment, and more particularly to exercise equipment for strengthening shoulders.

BACKGROUND

Physical therapy and the exercise required for shoulder rehabilitation are currently hampered by a lack of dynamic, weight-bearing equipment which isolates the shoulder joint in 360 degrees of motion. The existing shortcomings in shoulder rehabilitation, in particular post-surgery rehabilitation, are attributable to the limited utility of elastic bands, medicine balls, dumbbells, and other conventional weight-room equipment and the ways this equipment is used to strengthen the shoulder. For example, conventional therapeutic and exercise equipment only allow for resistance in one plane of shoulder-joint motion at any one time, such as motion in the coronal plane about an anterior-posterior axis, and motion in the sagittal plane about a medial-lateral axis. Additionally, because the surgical procedures currently offered for shoulder repair are far from ideal, athletes and/or physicians frequently rely on physical therapists to provide treatment to a shoulder joint left weak and/or unstable from the surgical procedure, often to no avail. Thus, a resistance system addressing the significant lack of dynamic weight bearing equipment approved for the shoulder joint problems in the current field of physical therapy and shoulder recovery is needed.

SUMMARY

According to an aspect of the disclosed technology, a representative embodiment of an apparatus for shoulder strengthening includes a base, a shaft having a distal end portion and a proximal end portion pivotably coupled to the base, a hand rest coupled to the distal end portion of the shaft such that the hand rest is configured to move with the shaft relative to the base, and a resistance mechanism configured to restrict movement of the shaft relative to the base. In some embodiments, the shaft is configured to rotate 360 degrees about a longitudinal axis of the base.

In some embodiments, the resistance mechanism is configured to apply an adjustable frictional force to the proximal end portion of the shaft. In further embodiments, the resistance mechanism is rotatably coupled to the base and configured to contact the proximal end portion of the shaft, and contact between the resistance mechanism and the proximal end portion of the shaft applies an adjustable frictional force to the proximal end portion. In such embodiments, rotation of the resistance mechanism in a first rotational direction relative to the base increases the adjustable frictional force applied to the shaft, and rotation of the resistance mechanism in a second rotational direction relative to the base decreases the adjustable frictional force applied to the shaft.

In further embodiments, the apparatus further includes a ball-and-socket joint coupling the proximal end portion of the shaft to the base. In such embodiments, the ball-and-socket joint includes a ball disposed in a socket. One of the proximal end portion of the shaft and the base includes the ball and the other of the proximal end portion and the base includes the socket. In further embodiments, the resistance mechanism is an annular structure and includes an internal thread disposed on an inner surface thereof, the internal threads being configured to mate with an external thread disposed an outer surface of the base such that the resistance mechanism is rotatably coupled to the base. Rotation of the resistance mechanism relative to the base produces relative axial motion between the resistance mechanism and both the base and the shaft such that the resistance mechanism engages and applies an adjustable frictional force to the ball of the ball-and-socket joint. In some embodiments, the proximal end portion includes the ball and the base includes the socket. In other embodiments, the base includes the ball and the proximal end portion includes the socket.

In another representative embodiment, a shoulder strengthening apparatus includes a base having a socket portion of a ball-and-socket joint, a shaft pivotably coupled to the base by the ball-and-socket joint, one end of the shaft being coupled to a hand rest and the other end of the shaft including a ball portion of the ball-and-socket joint, wherein the shaft is movable between an extended state and a compressed state; and a resistance mechanism rotatably coupled to the base and configured to adjustably restrict movement of the ball portion of the shaft relative to the base.

In some embodiments, the shaft includes a biasing member extending between the hand rest and the ball portion of the shaft such that the shaft is extendable and compressible. In other embodiments, the shaft includes two or more shaft portions and a longitudinal axis, the shaft portions being configured to move axially and telescopically along the longitudinal axis of the shaft. In further embodiments, a locking mechanism configured to secure the shaft in the extended and compressed states, is included. In some embodiments, the hand rest includes a curved portion to curl and support one or more fingers of a user.

In some embodiments, the apparatus further includes a stabilization element, the stabilization element having an arm rest to support an arm of the user and a support structure coupled on one end to the base and on the other end to the arm rest. In such embodiments, the arm rest is pivotably coupled to the support structure. In some embodiments, the support structure is configured to move radially about the longitudinal axis of the base such that the stabilization element is configured to move in a circumferential direction about the base and the shaft. In further embodiments, the arm rest is configured to limit rearward motion of an arm of a user.

In another representative embodiment, a shoulder strengthening apparatus includes a base including a longitudinal axis, a shaft including a proximal end portion, a distal end portion, and a longitudinal axis, a length of the shaft being adjustable along the longitudinal axis of the shaft, a ball-and-socket joint pivotably coupling the proximal end portion of the shaft to the base, a hand rest coupled to the distal end portion of the shaft and including a curved portion configured to curl one or more fingers of a user, and an annular structure rotatably coupled to the base and configured to engage and apply an adjustable frictional force to a ball of the ball-and-socket joint. The shaft is configured to pivot and rotate about the longitudinal axis of the base. Rotation of the annular structure in a first direction relative to the base increases the frictional force applied to the shaft, and rotation of the resistance mechanism in a second direction relative to the base decreases the frictional force applied to the shaft.

The foregoing and other objects, features, and advantages of the disclosed technology will become more apparent from the following detailed description, which proceeds with reference to the accompanying figures.

DETAILED DESCRIPTION

General Considerations

Figure 1:
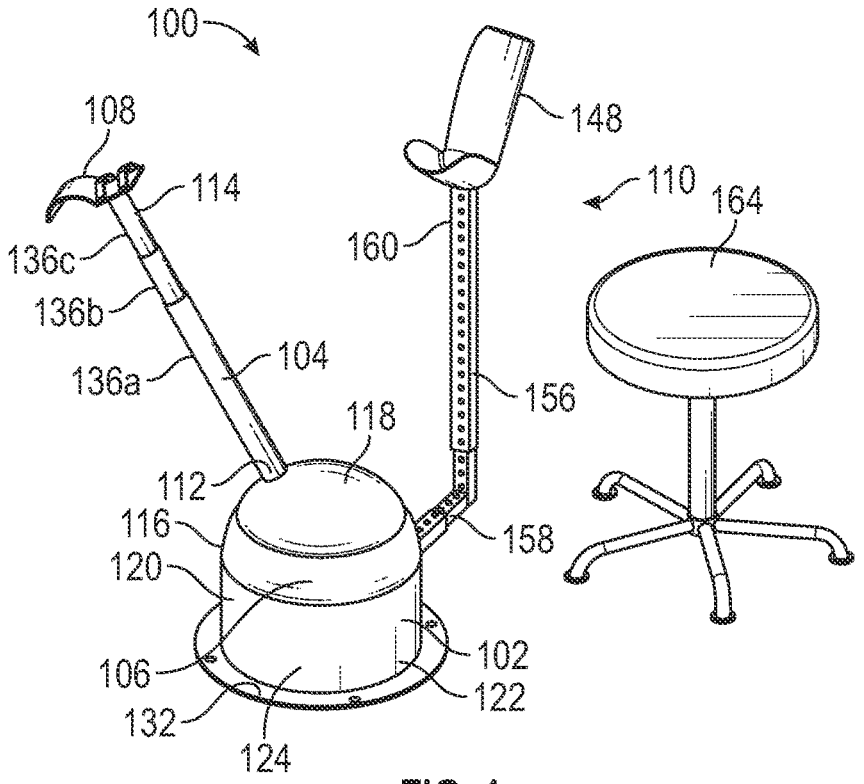
FIG. 1 is a perspective view of a resistance system of the present disclosure.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present, or problems be solved. Any theories of operation are to facilitate explanation, but the disclosed systems, methods, and apparatus are not limited to such theories of operation.

In some examples, values, procedures, or features are referred to as "lowest," "best," "minimum," or the like. It will be appreciated that such descriptions are intended to indicate that a selection among many used functional alternatives can be made, and such selections need not be better, smaller, or otherwise preferable to other selections.

As used in the application and in the claims, the singular forms "a," "an," and "the" include the plural forms unless the context clearly dictates otherwise. Additionally, the term "includes" means "comprises." Further, the terms "coupled" and "connected" generally mean electrically, electromagnetically, and/or physically (e.g., mechanically or chemically) coupled or linked and does not exclude the presence of intermediate elements between the coupled or associated items absent specific contrary language.

As used in this application, the term "and/or" used between the last two of a list of elements any one or more of the listed elements. For example, the phrase "A, B, and/or C" means "A," "B," "C," "A and B," "A and C," "B and C," or "A, B, and C."

Directions and other relative references (e.g., inner, outer, upper, lower, etc.) may be used to facilitate discussion of the drawings and principles herein, but are not intended to be limiting. For example, certain terms may be used such as "inside," "outside," "top," "down," "interior," "exterior," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

As used herein, the term "proximal" refers to a position, direction, or portion of a device that is closer to the base and further away from the hand rest. As used herein, the term "distal" refers to a position, direction, or portion of a device that is further away from the base and closer to the hand rest. The terms "longitudinal" and "axial" refer to an axis extending in the proximal and distal directions, unless otherwise expressly defined. Further, the term "radial" refers to a direction that is arranged perpendicular to the axis and points along a radius from a center of an object (where the axis is positioned at the center, such as a longitudinal axis of the base). The term "circumferential" refers to a direction that is arranged within a plane perpendicular to the axis and curves along a path around a center of an object, such as along a curved path about a longitudinal axis of the base.

The following description makes several references to dimensions and/or other values to describe various features of the disclosed technology. Such dimensions are not, however, intended to be absolute or exhaustive but are utilized to discuss various configurations of the technology. Each dimension and/or value expressly contained herein are also considered to include both the express value(s) and/or range of values within an allowable amount of variation of the specified quantity (e.g., a tolerance), including values expressed in terms of a "minimum" and/or a "maximum." For example, each value and/or range of values used herein are considered to include both the express value(s) as well as values within plus or minus 10 of the specified value, no matter the unit. Likewise, an angle and/or range of angles are considered to include both the express angle values as well as the angle values within plus or minus 10 degrees of the specified angle.

Examples of the Disclosed Technology

There is a growing consensus among physical therapists and medical practitioners that the use of elastic bands and other conventional equipment used for shoulder rehabilitation show lack of efficacy. The shoulder joint is a ball-in-socket joint and has nearly 360 degrees of motion in multiple planes, making it the most dynamic and unstable joint in the body. In addition, the most common muscles and joint injuries among athletes and the general population are the various muscles that attach around the shoulder joint as well as the cartilage and the labrum, which surround the joint. Thus, an exercise system which can advance the current state of available equipment for shoulder rehabilitation is needed.

The resistance systems disclosed herein can, for example, provide 360 degrees of dynamic resistance to a user's shoulder. The shoulder-resistance system utilizes frictional forces applied to a spherical portion of a ball-and-socket joint such that movement of a shaft extending from the ball-and-socket joint is restricted in all planes of motion, for example, both in linear and rotational motion.

Figure 2:
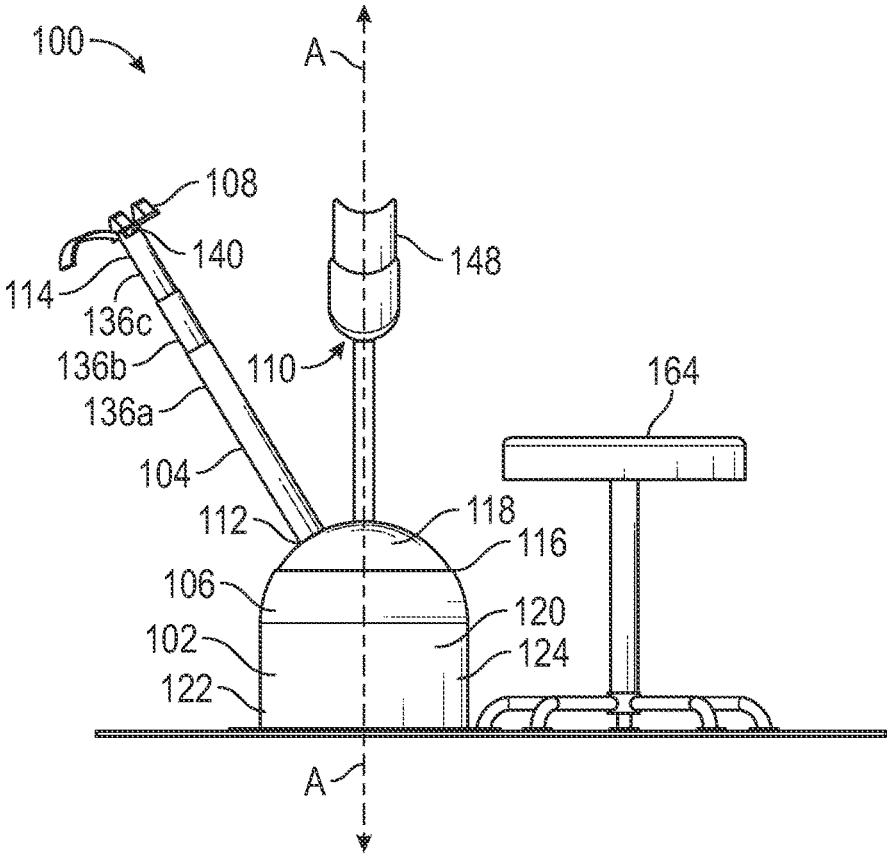
FIG. 2 is a side view of the resistance system of FIG. 1.

FIGS. 1-6 depict an exemplary resistant system 100. As shown in FIGS. 1 and 2, the resistance system 100 can comprise a base 102, a shaft 104, and a resistance mechanism 106 configured to restrict movement of the shaft 104 relative to the base 102. The resistance system 100 can also include a hand rest 108 and a stabilization element 110 coupled to the base 102. In representative embodiments, the shaft 104 includes a proximal end portion 112 pivotably coupled to the base 102 and a distal end portion 114 with the hand rest 108 coupled thereto. The resistance mechanism 106 can also be configured to apply a linear or frictional force to the proximal end portion 112 of the shaft 104 to restrict the movement of the shaft 104 and hand rest 108 relative to the base 102. In further embodiments, the stabilization element 110 can bear the weight of and limit rearward motion of the arm of the user.

Referring to FIGS. 1 and 2, the base 102 of the resistance system 100 includes an upper end portion 120, a lower end portion 122, an outer surface 124, and an inner surface 126 that forms an inner cavity 128 within the body of the base 102. The base 102 also includes a centrally located longitudinal axis A extending the length (or height) of the base 102 through both the lower end portion 122 and the upper end portion 120. The longitudinal axis A can, for example, be perpendicular to a floor or ground surface on which the base 102 is positioned and define an origin in which movement of the other components of the resistance system 100 (e.g., the shaft 104, hand rest 108, and/or stabilization element 110) can be described. For example, movement of the individual or collective components of the system 100 can be described relative to the longitudinal axis A.

The outer surface 124 of the base 102 extends radially outwardly from, and circumferentially around the longitudinal axis A between the lower end portion 122 and the upper end portion 120. In this way, the base 102 is cylindrical in shape and elongated upward from the ground surface. In some embodiments, however, the base 102 can be formed in a different shape. For example, in some embodiments, the base 102 can have a conical, pyramidal, cubic, rectangular, circular, or other three-dimensional shape.

Figure 4:
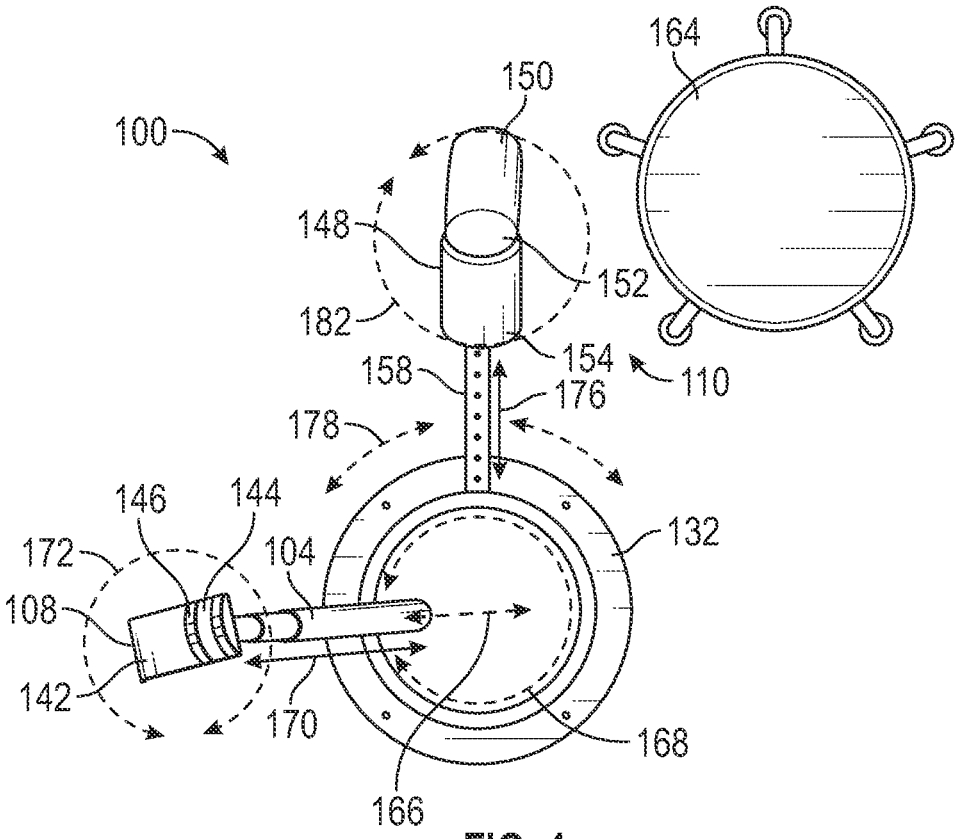
FIG. 4 is a top-down view of the resistance system of FIGS. 1-3, and the multidirectional movement thereof.

The lower end portion 122 can include a rim 132 (FIG. 4). The rim 132 can extend radially outwardly and circumferentially around the diameter, or a portion thereof, of the lower end portion 122. The rim 132 can be configured for attaching the base 102 and the resistance system 100 to a floor, ground, and/or external surface. For example, the base 102 can be mounted and stabilized to an external surface via one or more brackets, bolts, pegs, straps, screws, adhesive, and/or a combination thereof, which are coupled to or form the rim 132. In some embodiments, the lower end portion 122 of the base 102 can be structured and/or have components attached thereto to be slidably coupled to a track system (e.g., guide rails, strips, slides, etc.) such that the resistance system 100 can be moved from a first position on the track to a second position on the track. For instance, in this manner, the resistance system 100 can be moved to various locations along a track system spanning a surface area or a particular length. In such embodiments, the pathway of the track system can have various configurations (e.g., circular, curved, etc.) and/or the lower end portion 122 can include a pin, latch, lock, hook, carabiner, or the like, which can be configured to anchor the base 102 and resistance system 100 in any one of the locations.

Figure 3:
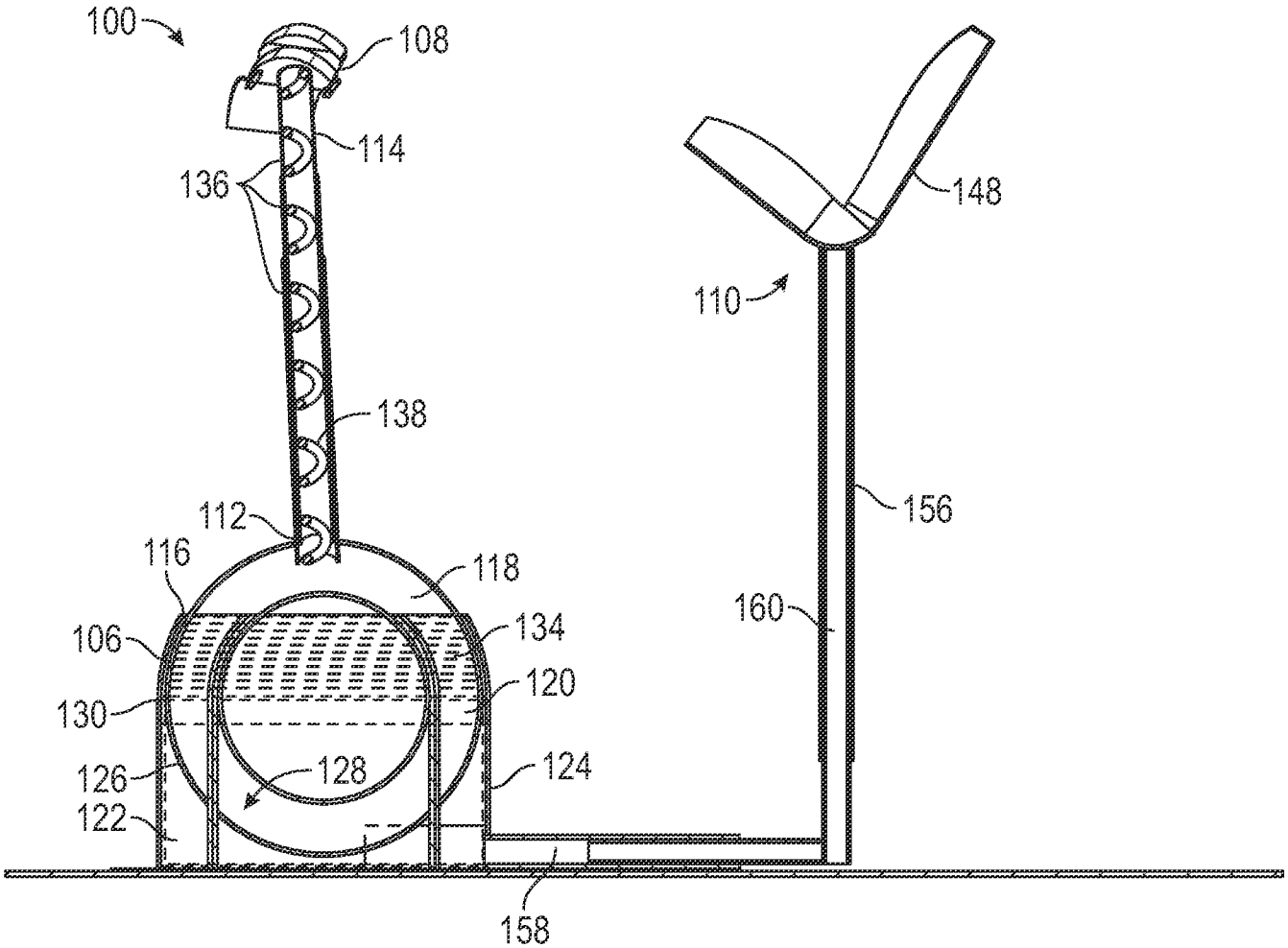
FIG. 3 is a cross-sectional, side view of the resistance system of FIGS. 1 and 2.

As shown in FIG. 3, which shows a cross-sectional view of the resistance system 100, the inner surface 126 of the base 102 can curve radially inward proximate the upper end portion 120 and toward the lower end portion 122 to form an inner cavity 128 within the body of the base 102. As such, the inner cavity 128 can form a socket 130 of a ball-and-socket joint 116 which allows other components, such as the shaft 104 and a hand rest 108 of the resistance system 100, to move relative to the base 102. The inner surface 126 of the inner cavity 128 can, for example, be a continuous surface, such as a single, solid continuous surface, or a surface formed of multiple components to collectively form the continuous surface (e.g., a plurality of adjacently spaced ribs). The inner surface 126 supports and permits a ball 118 of the ball-and-socket joint 116 to pivot and rotate relative to the inner cavity 128 and the longitudinal axis A of the base 102.

Referring to FIGS. 1-6, the resistance system 100 includes a shaft 104 that is pivotable and rotatable relative to the base 102 (e.g., relative to the longitudinal axis A) and has a length which can be adjusted. The shaft 104 can include the proximal end portion 112 pivotably and rotatably coupled to the base 102 by way of the ball-and-socket joint 116 and the distal end portion 114 opposite the proximal end portion 112 and having a hand rest 108 coupled thereto. The proximal end portion 112 can, for example, have or be coupled to a spherical structure that forms the ball 118 of the ball-and-socket joint 116 which is positioned and lies in the inner cavity 128 of the base 102 and renders the shaft 104 capable of multidirectional movement and rotation. For example, the ball-and-socket joint 116 allows the shaft 104 to be aligned with the longitudinal axis A of the base 102 or oriented (e.g., pivoted as indicated by arrows 166 in FIGS. 4-5) away from the longitudinal axis A such that the shaft 104 forms an acute angle relative to the longitudinal axis A (e.g., see FIGS. 1-2 and 4-5). The shaft 104 can, in some embodiments, pivot from the longitudinal axis A at angles ranging from 0 degrees to 90 degrees, with angles ranging from 0 degrees to 70 degrees as a particular example.

As the shaft 104 is pivoted or positioned relative to the longitudinal axis A, the motion of the distal end portion 114 of the shaft 104 and the hand rest 108 coupled thereto, follow a curved path similar to the curvature of the outer surface of the ball 118 as the portion of the ball 118 in contact with the inner surface 126 of the inner cavity 128 moves along the inner surface 126. In this configuration, the shaft 104 can also rotate about and around the longitudinal axis A. For instance, as indicated by arrows 168 in FIGS. 4-6, while in a pivoted position and forming an angle with the longitudinal axis A, the shaft 104 can rotate around the longitudinal axis A such that the distal end portion 114 of the shaft 104 can rotate 360 degrees around and within a plane perpendicular to the longitudinal axis A in a clockwise and/or counterclockwise direction. As such, the shaft 104 and hand rest 108 can be manipulated in multiple directions in 360 degrees of rotation around the longitudinal axis A.

To generate resistance to user movement, the resistance system 100 has an annular or ring-shaped resistance mechanism 106 configured to restrict the movement of the shaft 104 relative to the base 102 and longitudinal axis A. The resistance mechanism 106 applies a linear or frictional force to the ball 118 of the ball-and-socket joint 116 through direct or indirect contact via a threaded engagement 134 (FIG. 3). For example, the ring-like structure of the resistance mechanism 106 permits the mechanism to be positioned proximate or atop the proximal end portion 112 of the shaft 104 (e.g., the ball 118) and can have internal threads or helical ridges disposed on its inner surface which is configured to mate with corresponding external threads of the outer surface 124 of the upper end portion 120 of the base 102. In this way, the resistance mechanism 106 is rotatably coupled to the base 102 and rotation of the resistance mechanism 106 relative to the base 102 and the shaft 104 produce relative axial motion between the resistance mechanism 106 and both the base 102 and ball 118 of the proximal end portion 112.

As the resistance mechanism 106 moves axially along the external thread of the base 102, the resistance mechanism 106 contacts the exposed surface area of the ball 118 (e.g., the surface of the ball 118 outside the inner cavity 128) such that a frictional force is created between the resistance mechanism 106 and the ball 118 at one or more points of contact. As such, in some embodiments, the contact between the resistance mechanism 106 and the ball 118 can also increase the frictional force between the inner cavity 126 and the portion of the ball 118 in contact with the inner cavity 128, as the ball 118 is drawn inward or in closer contact with the inner surface 126. In this manner, the frictional force between the resistance mechanism 106 and the ball 118 and/or the frictional force between the ball 118 and the inner cavity 128 restricts the directional movement of the shaft 104 and provides resistance to the user, thereby creating the situation where the user works against the frictional forces to manipulate the movement of the shaft 104. For example, in some embodiments, the frictional force of the resistance mechanism 106 relative to the ball 118 can be increased by rotating the resistance mechanism 106 in a first rotational direction (e.g., clockwise) relative to the ball 118 and/or base 102. The frictional force of the resistance mechanism 106 relative to the ball 118 can be decreased by rotating the resistance mechanism 106 in a second rotational direction (e.g., counterclockwise) relative to the ball 118 and/or base 102.

In some embodiments, the pitch of the threaded engagement 134, or in other words, the linear distance the resistance mechanism 106 travels in one revolution via the engagement 134, can be proportional to the frictional force applied to the ball 118 of the proximal end portion 112. For example, the more revolutions (e.g., clockwise or counterclockwise) of the resistance mechanism 106 relative to the base 102 via the threaded engagement 134, the more axial movement occurs which results in an increase in frictional force and more resistance to the user. In the same manner, the same revolutions of resistance mechanism 106 can be reversed or undone, thereby easing the frictional forces and resistance to the user.

In lieu of a threaded connection, the relative axial motion between the resistance mechanism 106 and both the base 102 and ball 118 of the proximal end portion 112 can be achieved by a variety of other mechanisms. For example, in some embodiments, straps, cranks, individual screws, elastics, a vise, and/or other alternative mechanisms can be implemented to move the resistance mechanism 106 relative to the ball 118 and/or to produce the frictional forces between on the ball 118 and the resistance mechanism and/or the inner cavity 128.

In some embodiments, the dimensions of the inner cavity 128 of the base 102 and the ball 118 of the proximal end portion 112 of the shaft 104 can be modified to alter the movement of the shaft 104 and hand rest 108 coupled thereto. For example, the curved motion of the distal end portion 114 and the hand rest 108 as the shaft 104 is pivoted can be more gradual or steep as the diameter or radius of the ball 118 is decreased, while being less gradual as the diameter or radius is increased. Changing the diameter in this way can, for example, be used to accommodate users with different physical characteristics, such as height and/or limb length and/or rehabilitation needs. In some embodiments, the ball 118 of the proximal end portion 112 of the shaft 104 can have a diameter ranging from 50 cm to 85 cm, with the diameter ranging from 60 cm to 75 cm as a particular example. The inner cavity 128 of the base 102, in this instance, can have a diameter or radius equal (or substantially equal) to permit the ball 118 to be disposed therein.

In some embodiments, the physical characteristics of the surface of the ball 118, resistance mechanism 106, and/or inner surface 126 of the inner cavity 128 can be modified to increase or decrease the frictional forces acting on the ball 118 (e.g., modify the coefficient of friction). The outer surface area of the ball 118 can, for example, have a low friction surface that decreases the frictional forces or a textured surface (e.g., rough or raised) that increases the frictional forces between the portions of the ball 118 and the inner cavity 128 in contact with one another. Additionally, or alternatively, the inner surface 126 of the cavity 128 and/or the surface of the resistance mechanism 106 which contacts the ball 118 can also be low friction or be textured and/or have a surface which resists the movement of the shaft, such as a rubber or polymer material. In other embodiments, the surface of one of the ball 118, inner cavity 128, or resistance mechanism 106 has a surface with a coefficient of friction less than the coefficient of friction of the other two components. In some embodiments, one of the ball 118, inner cavity 128, or resistance mechanism 106 has a smooth surface as to offset a portion of the overall frictional forces. As such, the frictional forces acting on the ball-and-socket joint 116 can be modified in varying degrees by altering the surface of its individual components.

Accordingly, as described herein, the resistance system 100 via the shaft 104 and ball-and-socket joint 116 provides dynamic and seamless motion around and relative to the longitudinal axis A of the base 102 which closely reflects the natural motion of the human arm and provides benefits therefrom. The shoulder joint rarely acts in a vacuum and in a single plane of motion at a time. By having a device that can provide resistance at each physiologic plane and angle, this will mimic as closely to physiologically possible what the shoulder joint experiences during motion.

In some embodiments, the socket 130 of the ball-and-socket joint 116 is formed of first and second portions. The first portion can be, for example, the inner cavity 128 of the base 102 while the second portion can be the resistance mechanism 106 such that the first portion can be said to be a lower socket portion and the second portion an upper socket portion.

In alternative embodiments, the proximal end portion 112 of the shaft 104 forms the socket 130 and the base 102 forms the ball 118 of the ball-and-socket joint 116 such that the ball 118 of the base 102 is disposed within the socket 130 of the proximal end portion of the shaft 104. For example, the inner surface 126 of the base 102 shown in FIG. 3, can extend radially outwardly (e.g., protruding) from the upper most end of the upper end portion 120, to form a spherical portion of the ball 118 (e.g., an upper half portion of the ball) while the proximal end portion 112 of the shaft 104 can include a cavity curving radially inward in the direction of the distal end portion 114. As such, the shaft 104 and the socket 130 thereof can move along the surface of the ball 118 of the base 102. In such embodiments, the resistance mechanism 106 is rotatably coupled to the base 102 and rotation of the resistance mechanism 106 relative to the base 102 and the shaft 104 produce relative axial motion between the resistance mechanism 106 and the base 102, the ball 118, and the socket 130.

Referring to FIGS. 1 and 2, the shaft 104 of the resistance system 100 can have two or more shaft portions 136 configured to slide telescopically and axially along the length (e.g., a longitudinal axis) of the shaft 104. The shaft 104 can also include a bias member 138 configured to help maintain the relative positioning of the distal end portion 114 and hand rest 108 to the rest of the system 100. The two or more shaft portions 136*a*, 136*b*, 136*c* can, for example, be formed of concentric tubular sections configured to slide into and/or out of one another to permit the length of the shaft 104 to be adjusted, as indicated by arrows 170 in FIGS. 4-6. The tubular sections of the shaft portions 136 can have decreasing diameters along the length of the shaft 104, from the proximal end portion 112 to distal end portion 114, such that each successive shaft portion 136 can lie within or partially within each preceding shaft portion. In some embodiments, the diameters of the shaft portions 136 can increase from the proximal end portion 112 to the distal end portion 114 such that each successive shaft portion 136 can at least partially surround the preceding shaft portion 136.

As shown in FIG. 3, the bias member 138 of the shaft 104 can be coupled to and extend between the distal end portion 114 and the proximal end portion 112 (e.g., proximate or from the ball 118). The bias member 138 can be a spring with a length and/or stiffness such that the distal end portion 114 and the hand rest 108 have a baseline or equilibrium position relative to the proximal end portion 112. This equilibrium position can, for example, be the positioning of the distal end portion 114 and hand rest 108 relative to the proximal end portion 112 in the absence of external influence, such as a locking mechanism or user manipulation. The stiffness of the bias member 138 can also draw the distal end portion 114 and hand rest 108 back toward the equilibrium position once the shaft 104 is lengthened or stretched to an extended stated and/or shortened to a compressed state, such as when the hand rest 108 is positioned from the proximal end portion 112 at distance other the equilibrium position to accommodate the user. As such, the bias member 138 accordingly compresses or extends to return the hand rest 108 back to the equilibrium position from the extended or compressed state. In some embodiments, the shaft 104 can have a total length ranging from 40 cm to 120 cm, with the total length ranging from 60 cm to 100 cm as a particular example.

The shaft 104 of the resistance system 100 can also include a locking mechanism 140 such that the length of the shaft 104 can be locked and unchanged while the locking mechanism 140 is engaged. The locking mechanism 140 can maintain the shaft 104 in an extended state or a compressed state, for example, as the shaft 104 is pivoted and/or rotated relative to the longitudinal axis A. In some embodiments, the locking mechanism 140 or a second locking mechanism can maintain the positioning of the hand rest 108 such that the hand rest 108 is prevented from rotating relative to the shaft 104.

Figure 5:
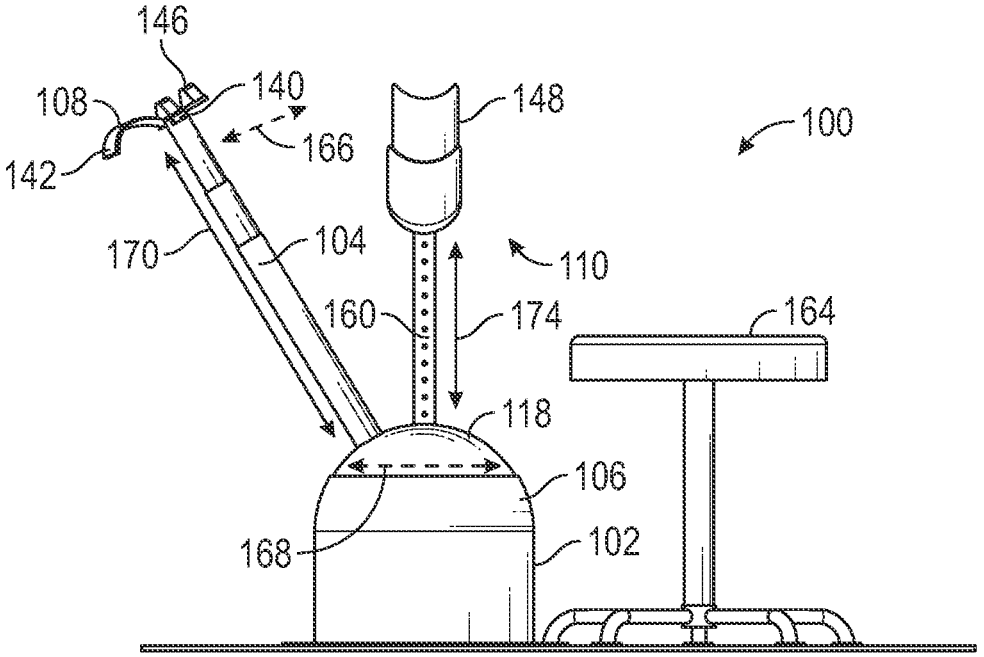
FIG. 5 is another side view of the resistance system of FIGS. 1-4.
Figure 6:
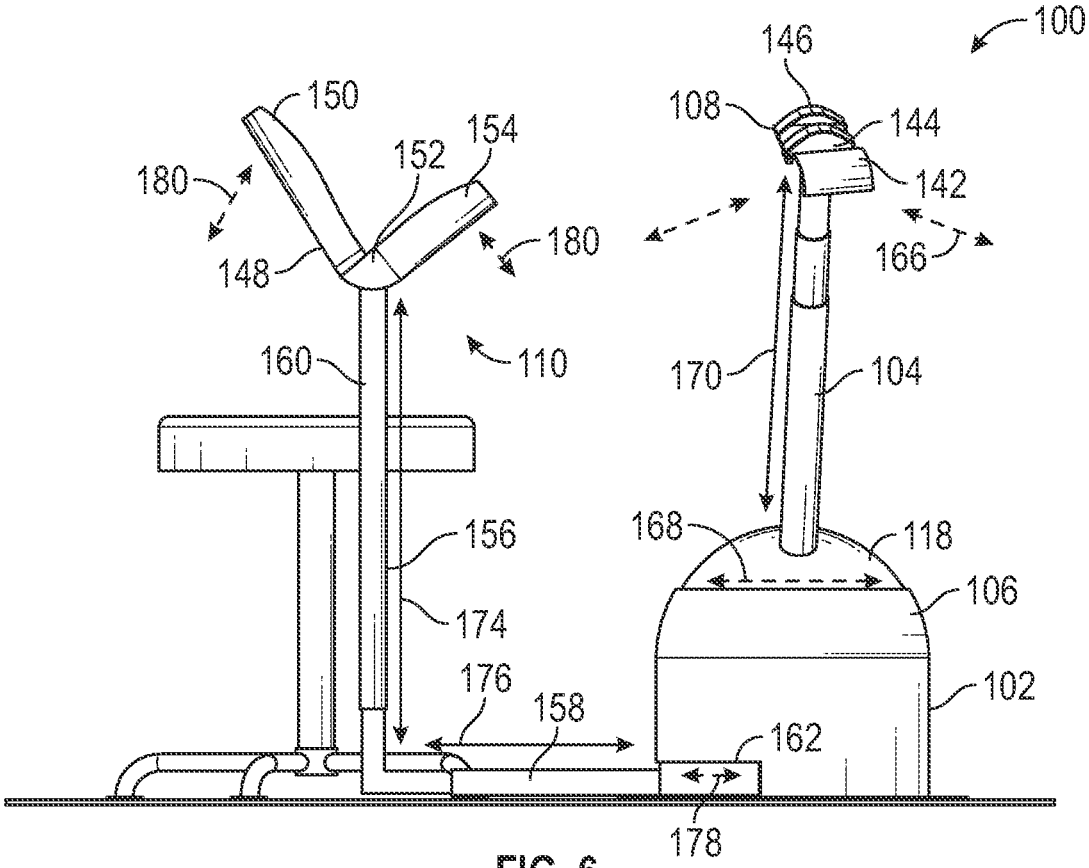
FIG. 6 is another side view of the resistance system of FIGS. 1-5.

As illustrated in FIGS. 4-6, the hand rest 108 of the resistance system 100 can be configured to support and secure the hand of the user. For example, the hand rest 108 can have a curved portion 142 which causes one or more fingers of the user to arc around the curved portion 142 and toward the end of the hand rest 108 oriented and directed away from the body of the user. The curved portion 142 can also have one or more recesses molded or formed to receive one or more fingers of the user such that the hand rest 108 can be customized and/or formed for a general user for additional support, comfort, and/or more securely retain the user's hand. This configuration which curls the fingers of the user can provide significant benefits, such as by ensuring the user's movement is primarily isolated to shoulder movement, rather than other parts of the arm. For example, in their relaxed state, the flexor muscles of the hands and forearms flex the digits of the hand with greater force than the extensors, thus by allowing the hand to remain as ergonomically natural as possible, muscle tension and the forces across unwanted joints such as in the wrist and elbow decrease, allowing further isolation of the shoulder joint.

The remaining structure of the hand rest 108 can include a flat or planar portion 144 which can be configured to support and secure the palm and/or wrist of the user. For example, the flat portion 144 can similarly be formed or molded to include palm and/or wrist shaped recesses to better retain the palm and/or wrist of an individual user as the user pivots and/or rotates the shaft 104. The flat portion 144 can also include a fastening mechanism 146, such as a strap or an elastic component to securely retain and restrict the movement of the user's hand and/or wrist relative to the hand rest 108. The fastening mechanism 146 can maintain the positioning of the hand directly or indirectly against the hand rest 108 to prevent the hand from moving in an upward direction, such as when the hand is drawn or lifted away from the surface of the hand rest 108. In this manner, retention of the user's hand can ensure movement of the user is directed primarily to isolated shoulder movement. As opposed to the user relying too heavily on hand movement to manipulate the positioning of the shaft 104 and thereby detracting from the dynamic 360-degree shoulder movement.

In some embodiments, the hand rest 108 is capable of rotational movement relative to the shaft 104 and the base 102. In particular, as indicated by the arrows 172 shown in FIG. 4, the hand rest 108 can be configured to rotate along a plane perpendicular to the longitudinal axis of the shaft 104 as the shaft 104 pivots and/or rotates relative to the base 102. In other words, the hand rest 108 can be configured to swivel clockwise or counterclockwise relative to the shaft 104 and base 102 while coupled to the distal end portion 114 and as a user manipulates the shaft 104. In further embodiments, the hand rest 108 can also be configured to pivot relative to the distal end portion 114.

FIGS. 4-6 show that the resistance system 100 can have a stabilization element 110 pivotably coupled to the base 102 and configured to limit rearward motion of the arm of the user. As best illustrated in FIGS. 4 and 6, the stabilization element 110 can include an arm rest 148 having outer, mid, and inner portions 150, 152, 154, configured to abut and support the upper arm, elbow, and forearm of the user, respectively. For example, the posterior or outer portion 150 can extend in an upward direction from the mid portion 152 to abut the posterior of the arm to limit rearward-linear motion of the user's arm, such as rearward movement sought to be avoided during rehabilitation exercises. The arm rest immobilizes the upper extremity joint motion around the elbow which directs and isolates the acting forces to the shoulder.

The mid and inner (or anterior) portions 152, 154 (which extends outwardly from the mid portion 152 toward the shaft 104) can brace the elbow and forearm. While the hand of the user is retained by the hand rest 108, the user can move their hand and/or forearm relative to the arm rest 148, such as about a longitudinal axis formed along the upper arm and elbow of the user. In this manner, the upper arm of the user can be held stationary and/or limited in its rearward motion relative to the shaft 104 and/or hand rest 108 by the outer and mid portions 150, 152 as the hand of the user manipulates the positioning of the shaft 104.

In some embodiments, the outer portion 150 can have a length ranging from 10 cm to 20 cm, with a length of 15 cm as a particular example while the inner portion 154 can have a length ranging from 7 cm to 17 cm, with a length of 12 cm as a particular example. In further embodiments, the outer portion 150 and/or the mid portion 152 can pivot toward and away from the other such that the angle formed by the outer, mid, and inner portions 150, 152, 154 can be modified. In such embodiments, the angle between the outer, mid, and inner portions can form angles ranging from 0 degrees to 110 degrees, with angles ranging from 0 degrees to 90 degrees as a particular example.

Still referring to FIGS. 4-6, the stabilization element 110 can also include an adjustable support structure 156 having a first portion 158 pivotably coupled to the base 102 and a second portion 160 having the arm rest 148 coupled thereto. To enable adjustment of the height and/or proximity of the stabilization element 110 relative the base 102, the first and second portions 158, 160 can also be configured to extend and compress in length perpendicular and/or parallel of the base 102, respectively. The first and second portions 158, 160 can, for example, be formed of a pull pin assembly which allows each portion to be slidably adjusted and situated at a desired length by mating a pin with one or more apertures of the slidable portions of the assembly. In this manner, the height of the support structure 156 can be adjusted by extending the second portion 160 upward or downward relative to the ground surface to which the base 102 is positioned, as indicated by arrows 174. As such, the arm rest 148 can be positioned at a height above, below, or level with the hand rest 108. Similarly, the first portion 158 can be adjusted such that the arm rest 148 can be positioned at varying distances away from the shaft 104 and hand rest 108, as indicated by arrows 176. The adjustable nature of the support structure 156 allows the arm rest 148 to be positioned in a way as to permit the user to sit on a nearby chair 164 or stand, and/or be adjusted to accommodate the individual physical characteristics of the user, such as arm length or height.

As shown in FIGS. 4 and 6, the support structure 156 can be rotatably coupled to the base 102 such that the support structure 156 can move in a circumferential direction relative to both the shaft 104 and base 102. In this way, the support structure 156 and arm rest 148 are configured to move with the user, clockwise or counter counterclockwise, as the user moves their arm or body relative to the shaft 104. For example, the first portion 158 can extend through a slot or an opening 162 and be rotatably coupled to the base 102, such as an internal portion of the base 102 below, around, and/or proximate to the inner cavity 128. In this configuration, the first portion 158 extends radially outwardly from the longitudinal axis A of the base 102 (e.g., perpendicular to the longitudinal axis A) and the support structure 156 can move side-to-side relative the shaft 104 and base 102 along a path which follows the curvature or shape of the base 102 and/or a path formed by the internal portion coupled thereto, as indicated by arrows 178.

In some embodiments, the slot or opening 162 can be shaped or formed to extend only a portion of the circumference or outer shape of the base 102 as to limit or restrict the circumferential movement of the support structure 156 to a range of motion relative to the longitudinal axis A and base 102. In some embodiments, for example, the support structure 156 can have a range of motion ranging from 0 degrees to 200 degrees about the longitudinal axis A, with a range of motion ranging from 0 to 135 degrees as a particular example.

Still referring to FIGS. 4 and 6, the arm rest 148 can also be pivotably and/or rotatably coupled to the upper most portion of the second portion 160 of the support structure 156 (e.g., relative to a ground). For example, the arm rest 148 can be configured to pivot toward and/or away from the shaft 104, as indicated by arrows 180, and/or rotate 360 degrees relative to longitudinal axis of the second portion 160, as indicated by arrow 182. In this manner, the arm rest 148 can be adjusted to accommodate the user and/or be oriented in a position favorable and/or optimal for shoulder movement. As such, the arm rest 148 can be positioned at an upward angle relative to the hand rest 108, at a downward angle relative to the hand rest 108, level with the hand rest 108 (e.g., the mid and inner portions 152, 154 level with the hand rest 108), or any angle therebetween.

In view of the many possible embodiments to which the principles of the disclosed technology may be applied, it should be recognized that the illustrated embodiments are only preferred examples of the technology and should not be taken as limiting the scope of the technology. Rather, the scope of the technology is defined by the following claims. I therefore claim as my invention all that comes within the scope and spirit of these claims.

The invention claimed is:

1. A method of utilizing a strengthening and rehabilitation apparatus, the method comprising:

adjusting resistance of a joint within a base of the strengthening and rehabilitation apparatus to provide a selected degree of resistance for restricting movement of a shaft relative to the base, a first end portion of the shaft coupled to the joint;

supporting a first portion of a user's body on a rest structure rotatably coupled to a second end portion of the shaft;

moving the rest structure with the first portion of the user's body supported on the rest structure along an exercise pathway, thereby moving the shaft relative to the base with the selected degree of resistance and rotating the rest structure relative to the shaft as the shaft moves relative to the base;

supporting a second portion of the user's body on a rotatable stabilization element; and limiting rearward motion of the first portion of the user's body via the supporting of the second portion of the user's body on the rotatable stabilization element.

2. The method of claim 1, wherein the shaft is a telescoping shaft comprising two or more telescoping shaft portions and a bias member, and the method further comprises moving the telescoping shaft between a compressed state and an equilibrium state.

3. The method of claim 2, wherein the telescoping shaft further comprises a lock, and the method further comprises locking the telescoping shaft in the compressed state.

4. The method of claim 1, further comprising securing the first portion of the user's body to the rest structure via strapping the first portion of the user's body to a planar portion of the rest structure.

5. The method of claim 1, wherein the rotating the rest structure relative to the shaft comprises swiveling the rest structure around a longitudinal axis of the shaft as the user manipulates the rest structure along the exercise pathway.

6. The method of claim 1, wherein the first portion of the user's body comprises a hand of the user.

7. The method of claim 1, wherein the first portion of the user's body comprises a wrist of the user.

8. The method of claim 1, wherein the rotatable stabilization element comprises an additional support structure for supporting the second portion of the user's body and a height-adjustable shaft, and wherein the method further comprises adjusting a height of the height-adjustable shaft so that the second portion of the user's body is disposed in a selected orientation relative to the first portion of the user's body.

9. The method of claim 1, wherein the first portion of the user's body comprises one or both of a hand or a wrist of the user, and wherein the second portion of the user's body comprises an elbow of the user.

10. The method of claim 1, wherein the adjusting resistance of the joint to provide a selected degree of resistance for restricting movement of the shaft relative to the base comprises providing a selected degree of resistance for restricting linear movement of the shaft relative to the base.

11. The method of claim 1, wherein the adjusting resistance of the joint to provide a selected degree of resistance for restricting movement of the shaft relative to the base comprises providing a selected degree of resistance for restricting rotational movement of the shaft relative to the base.

12. The method of claim 1, wherein the moving the shaft relative to the base with the selected degree of resistance comprises one or more of pivoting or rotating the shaft relative to the base.

13. The method of claim 1, wherein the rotating the rest structure relative to the shaft as the shaft moves relative to the base comprises pivoting the rest structure along a plane perpendicular to a longitudinal axis of the shaft.

14. A method of utilizing a strengthening and rehabilitation apparatus, the method comprising:

adjusting resistance of a joint within a base of the strengthening and rehabilitation apparatus to provide a selected degree of resistance for restricting movement of a first shaft relative to the base, a first end portion of the first shaft coupled to the joint;

supporting a first portion of a user's body on a first rest structure rotatably coupled to a second end portion of the first shaft;

securing the first portion of the user's body to the first rest structure;

moving the first rest structure with the first portion of the user's body secured to the first rest structure along an exercise pathway, thereby rotating the first shaft relative to the base with the selected degree of resistance;

pivoting the first rest structure along a plane that is perpendicular relative to a longitudinal axis of the first shaft as the first shaft is rotated relative to the base;

supporting a second portion of the user's body on a second rest structure rotatably coupled to a second shaft; and limiting rearward motion of the first portion of the user's body via the supporting of the second portion of the user's body on the second rest structure.

15. The method of claim 14, wherein the first portion of the user's body comprises one or both of a hand or a wrist of the user, and wherein the second portion of the user's body comprises an elbow of the user.

* * * * *